US006688317B2

(12) United States Patent
Gueret

(10) Patent No.: US 6,688,317 B2
(45) Date of Patent: Feb. 10, 2004

(54) PACKAGING AND APPLICATOR DEVICE HAVING AN APPLICATOR AREA WITH PRIVILEGED FEED

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/877,434

(22) Filed: Jun. 8, 2001

(65) Prior Publication Data

US 2002/0014254 A1 Feb. 7, 2002

(30) Foreign Application Priority Data

Jun. 28, 2000 (FR) ..... 00 08311

(51) Int. Cl.[7] ..... A43D 40/26
(52) U.S. Cl. ..... 132/320
(58) Field of Search ..... 132/320; 401/135, 401/175, 196, 205, 139, 121

(56) References Cited

U.S. PATENT DOCUMENTS

| | | | | | |
|---|---|---|---|---|---|
| 3,179,972 | A | * | 4/1965 | Fillmore | 132/320 |
| 3,807,881 | A | * | 4/1974 | Seidler | 401/175 |
| 3,825,021 | A | * | 7/1974 | Seidler | 132/320 |
| 4,368,746 | A | * | 1/1983 | Spatz | 132/320 |
| 4,772,148 | A | | 9/1988 | Buschemeyer | |
| 4,902,155 | A | * | 2/1990 | Buschemeyer | 401/205 |
| 5,131,773 | A | | 7/1992 | Gueret | |
| 5,199,808 | A | | 4/1993 | Gueret | |
| 5,738,067 | A | * | 4/1998 | Landwehr et al. | 132/320 |
| 5,772,347 | A | * | 6/1998 | Gueret | 401/175 |
| 5,797,692 | A | * | 8/1998 | Poole et al. | 401/139 |
| 5,851,079 | A | | 12/1998 | Horstman et al. | |
| 5,908,256 | A | * | 6/1999 | Bernstein | 401/205 |
| 6,076,534 | A | | 6/2000 | Gueret | |
| 6,099,184 | A | * | 8/2000 | Koptis | 401/205 |
| 6,309,128 | B1 | * | 10/2001 | Griebel et al. | 401/175 |
| 6,450,722 | B1 | | 9/2002 | Ruschke et al. | |

FOREIGN PATENT DOCUMENTS

| | | |
|---|---|---|
| EP | 0 245 983 A2 | 11/1987 |
| EP | 0 732 273 A | 9/1996 |
| EP | 1 044 625 A1 | 10/2000 |
| FR | 2 727 608 A | 9/1996 |
| FR | 2 773 959 | 7/1999 |

* cited by examiner

*Primary Examiner*—Todd E. Manahan
(74) *Attorney, Agent, or Firm*—Oblon, Spivak, McClelland, Maier & Neustadt, P.C.

(57) ABSTRACT

A device for packaging and applying a cosmetic or care product, the device having a reservoir containing the product and an applicator endpiece for dispensing and applying the substance contained in the reservoir, the endpiece defining an applicator surface that is fed with the substance via at least one orifice, wherein the orifice opens out into a cavity or groove placed at a distance from the applicator surface, the groove or cavity being arranged in such a manner that the applicator surface is fed with the substance in a privileged manner via a first fraction of the groove or cavity, the remaining portion of the groove or cavity communicating with the first fraction and being effective in collecting all or part of the excess substance present on the applicator surface.

132 Claims, 4 Drawing Sheets

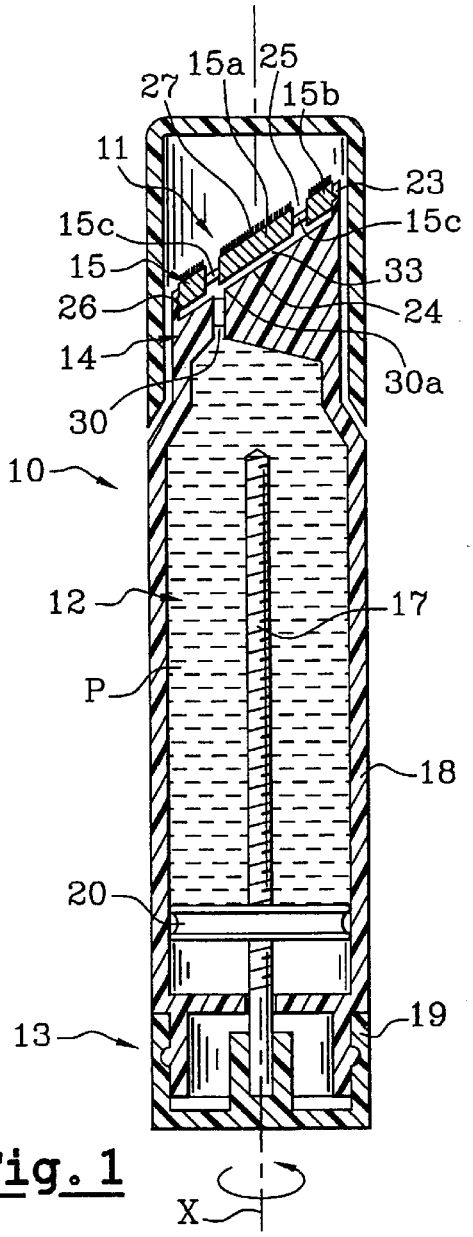
Fig. 1
Fig. 2
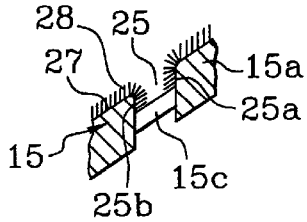
Fig. 3
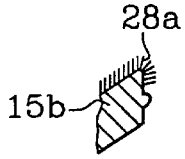
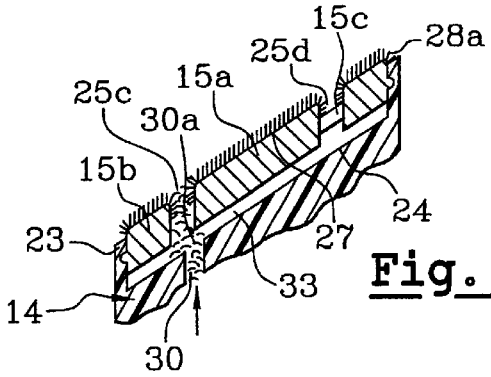
Fig. 4
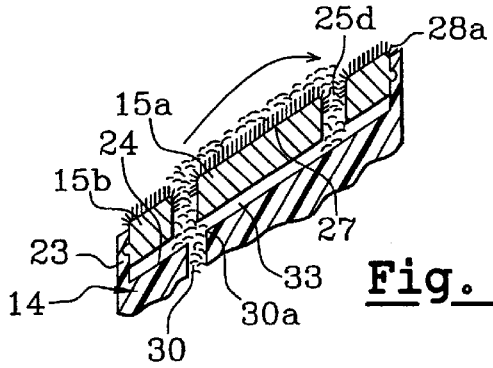
Fig. 6
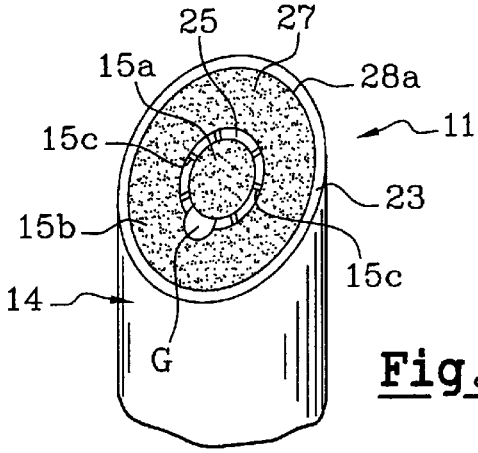
Fig. 5
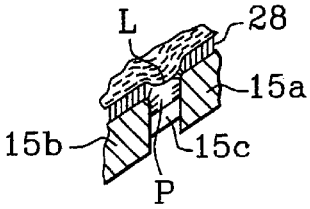
Fig. 7

Fig. 18
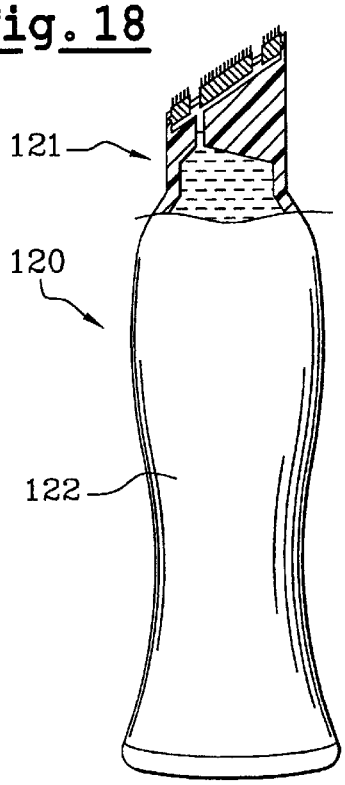
Fig. 19
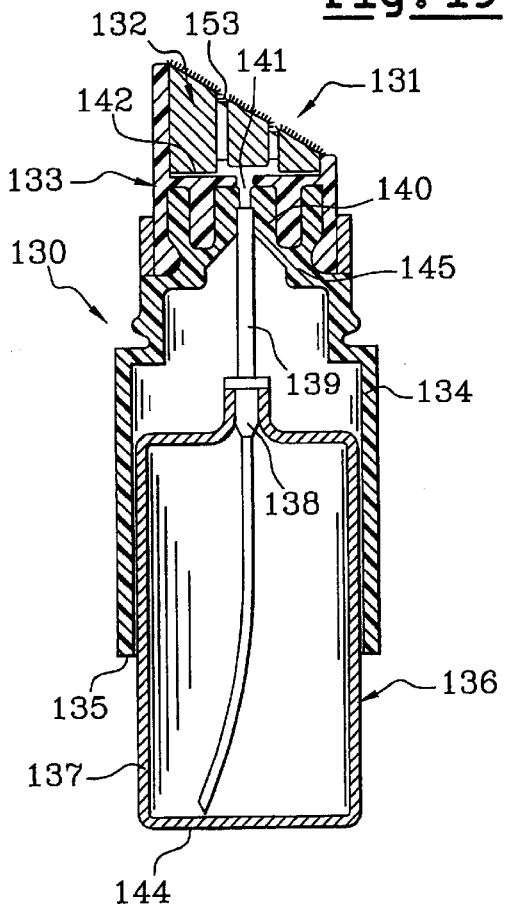
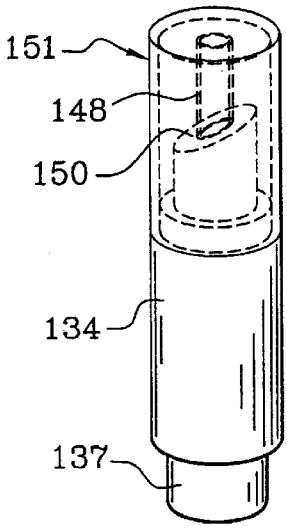
Fig. 20
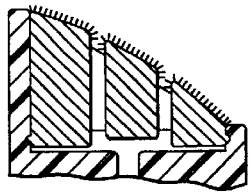
Fig. 21
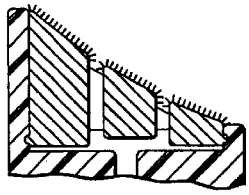
Fig. 22
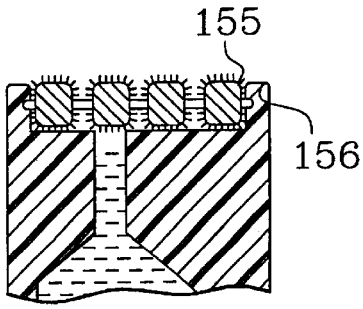
Fig. 23

PACKAGING AND APPLICATOR DEVICE HAVING AN APPLICATOR AREA WITH PRIVILEGED FEED

The present invention relates to applying a cosmetic or a care product, in particular on the lips, the eyelids, or the remainder of the face.

BACKGROUND OF THE INVENTION

French patent No. FR-B-2 727 608 describes an endpiece having an array of points or tips, and a substance outlet duct at the center of the applicator surface.

The end of the duct lies at substantially the same level as the free ends of adjacent points.

The substance which is to be found between the points can dry out and generate dirt.

Above-cited French patent No. FR-B-2 727 608 also describes endpieces each comprising a plurality of outlet orifices opening in register with the openings in a grid.

The substance is dispensed in substantially uniform manner over the entire applicator area via the above-mentioned orifices.

Patent No. FR-B-2 727 608 also describes an endpiece having an annular groove with a multitude of orifices spaced apart regularly in the bottom of the groove so that the grooves becomes uniformly filled with the substance.

With those known endpieces, there exists the risk of excess substance being brought to the applicator surface and of it being expelled from said surface on coming into contact with the surface to be treated.

OBJECTS AND SUMMARY OF THE INVENTION

The invention seeks to remedy the above-mentioned drawbacks in full or in part.

The invention achieves this by means of a device for packaging and applying a cosmetic or a care product, the device comprising a reservoir containing said substance and an applicator endpiece for dispensing and applying the substance contained in the reservoir, said endpiece defining an applicator surface that is fed with substance via at least one orifice, wherein said orifice opens out into a cavity or groove at a distance from said applicator surface, said groove or cavity being arranged in such a manner that the applicator surface is fed with substance in privileged manner via a first fraction of said groove or cavity, said groove or cavity having a second fraction communicating with the first and suitable for collecting all or part of the substance present in excess on the applicator surface.

By means of the invention, the substance can be bought to the applicator surface, at least during first use, without the entire groove or cavity into which the orifice opens out becoming filled with substance.

Thus, any excess substance on the applicator surface can be received in the region of the groove or cavity that is not filled with substance and can avoid being expelled from the endpiece by the surface to be treated.

Furthermore, because the orifice opens out into a groove or cavity at a distance from the applicator surface, it is easier to flock the applicator surface, at least in part, without danger of the bristles or adhesive used for flocking purposes blocking the orifice.

The invention thus makes it possible to perform flocking without it being necessary to re-pierce the orifice in order to repair it and without it being necessary to use a removable insert that is inserted in the orifice during the flocking operation.

In a particular embodiment, the applicator surface includes at least one chamfered portion.

Thus, the endpiece can be of a shape analogous to that of a lipstick.

In a particular embodiment, the groove or cavity is flocked at its opening that opens out into the applicator surface.

This makes applicator more comfortable.

Advantageously, the entire applicator surface is flocked.

The orifice can be eccentric in the endpiece.

When the applicator surface has at least one chamfered portion, the orifice can be situated in the bottom part of said chamfered portion.

In order to bring the substance in privileged manner onto the applicator surface, said groove or cavity can present paths between said orifice and the applicator surface that impart different amounts of head loss on the substance so that the substance follows a privileged path.

Said groove or cavity can be of varying height.

Only one orifice need open out into the groove or cavity.

In a preferred embodiment, the endpiece comprises a first part and a second part fitted to the first, said second part defining at least a fraction of the applicator surface.

The second part can be fixed inside a housing defined by the first part, said housing being of a shape complementary to that of the second part.

The groove or cavity can be made at least in part by one or more openings in the second part.

The first and second portions of the groove or cavity can communicate via a space defined between the first and second parts.

Such a space can allow substance to flow back under the second part, so that there is less risk of the substance drying out or deteriorating on the endpiece.

Furthermore, any substance contained in the above-mentioned second portion of the groove or cavity, while the substance is flowing back, will tend to be sucked in by the substance flowing in or towards the first portion of the groove or cavity, such that the second portion of the groove or cavity is emptied at least in part and, where appropriate, can receive new substance that might be present in excess on the applicator surface.

In addition, the use of two parts that are assembled together makes it easier to implement flocking since one of said parts can be flocked separately and more easily, possibly with reduced risk of the coating of flocking blocking one or more orifices used for feeding the substance.

Preferably, one of the two parts has a coating of flocking which extends to the edge of said part, said edge being in contact with a non-flocked edge of the other part.

Such an implementation makes it possible to obtain a coating of flocking whose outline is sharp, and that facilitates obtaining neat makeup.

The first part can have an outer annular skirt that is not flocked.

The two parts can be fixed one inside the other by snap-fastening, with the two parts preferably including sealing means so as to obtain a connection that is leakproof.

In a variant, the two parts can be fixed to each other by heat-sealing, adhesive, or hot upsetting.

In a preferred embodiment, the second part includes a grid or is constituted by a grid.

The second part advantageously includes an annular groove or cavity extending around a closed curve, possibly a curve that is other than circular.

The groove or cavity preferably does not present any narrowing in its section towards its outside opening, thus enabling the surface of the skin or the lips to penetrate more deeply therein so as to extract any substance, where appropriate.

In a particular embodiment, the second part is of varying height, so as to define a chamfered applicator surface and create a preferred path for the substance.

The second part can include an element that co-operates with the first part so as to form a check valve suitable for opening under drive from the pressure of the substance.

This valve serves to protect substance upstream from the endpiece from dirtying and from oxidation.

The first part can include a jet-deflector central region situated in or facing a passage for feeding the substance. In a variant, the second part can include a jet-deflector region situated facing a passage for feeding the substance.

The applicator surface of the endpiece can include a chamfered surface and a side surface that extends around the chamfered surface, said chamfered and side surfaces both being flocked. The applicator surface can be free of any portions in relief such as points.

Advantageously, the orifice(s) through which the fluid feed passage open out into the bottom of said groove(s) or cavity(ies) is/are set back from the applicator surface by a distance of at least 1 millimeter (mm).

The groove(s) or cavity(ies) can be relatively wide, for example two opposite edges can be spaced apart by more than 1 mm, with the distance between said edges being preferably selected in such a manner that the surface of the lips or the skin can reach the substance contained therein.

The second part can be made out of material that is flexible or rigid.

The second part can be made out of a material that is different from that used for making the first part. To make the first and/or the second parts, it is possible to use one or more plastics material(s) selected from the following list: ethylene-propylene diene monomer (EPDM) elastomer, nitrile rubber, latex, thermoplastic elastomer of polystyrene (PS), polyethylene terephthalate (PET), polyurethane (PU), ethylene vinyl acetate (EVA), polyvinyl chloride (PVC), "Polynorborden", or a relatively rigid thermoplastic material such as polypropylene (PP), polyethylene (PE), PS, PET, polycarbonate (PC), etc.

In a particular embodiment, the coating of flocking extends to an edge that presents undulations.

In a particular embodiment, the second part includes a central region and a peripheral region that are interconnected by bridges of material.

These bridges of material need not be flocked, particularly if they are set back significantly from the applicator surface.

In a particular embodiment, the second part is off-centered relative to the first part, thus making it possible, where appropriate, to make an endpiece that is more ergonomic.

The reservoir can be formed by a body formed integrally with one of the parts of the endpiece.

The device can include a piston for exerting pressure on the substance contained in the reservoir for the purpose of dispensing it.

The reservoir can also include a compressible wall enabling the substance to be dispensed by exerting pressure thereon, e.g. by the user exerting pressure.

The device can also include a pump.

The reservoir can be removable, in which case it can constitute a refill.

When the device includes a pump, the reservoir is advantageously movable relative to the remainder of the device so as to actuate the pump in order to dispense a quantity of the substance.

Advantageously, the device includes a closure cap containing at least one internal shutter member suitable for covering the substance outlet orifice(s) when it is in place on the endpiece.

The invention also provides a method of manufacturing an endpiece as defined above, wherein the endpiece is made with a coating of flocking without piercing the orifice after the flocking has been performed and without inserting an insert in said orifice during flocking.

This ensures that manufacturing the endpiece is relatively simple.

Furthermore, by avoiding any need to pierce the endpiece after flocking has been performed, it is ensured that surface roughnesses or starters for peeling off the flocking coating are not formed, particularly when the endpiece has a flocked portion that is flexible, for example because it is made of elastomer.

BRIEF DESCRIPTION OF THE DRAWINGS

The invention will be better understood on reading the following detailed description of various non-limiting embodiments of the invention, and on examining the accompanying drawings, in which:

FIG. 1 is a diagrammatic axial section view of a packaging and applicator device of the invention;

FIG. 2 shows a detail of FIG. 1;

FIG. 3 shows a portion of the periphery of the grid in isolation;

FIG. 4 is a fragmentary view of the endpiece showing how it is fed with substance;

FIG. 5 is a diagrammatic perspective view of the endpiece;

FIG. 6 shows how substance is recovered by the groove or cavity of the endpiece;

FIG. 7 shows how the skin or the mucous membrane of the lips is deformed on coming into contact with the endpiece and how it comes into contact with the substance contained in a groove or cavity of the endpiece;

FIGS. 18 to 20 show various ways in which the substance can be packaged;

FIGS. 21 to 22 show endpieces with applicator surfaces that are respectively outwardly convex and concave; and FIG. 23 shows an endpiece in which the second part is flocked in its entirety.

MORE DETAILED DESCRIPTION

Figure 8:
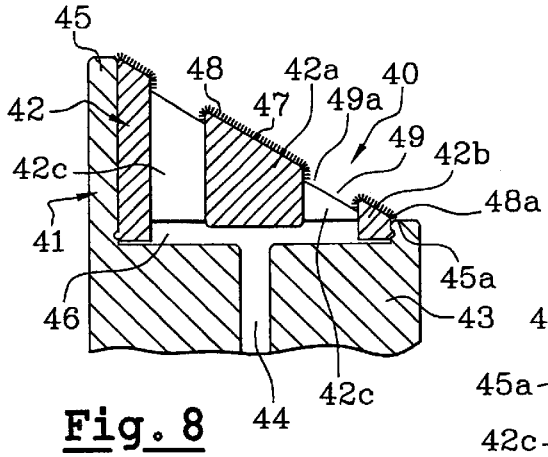
FIGS. 8 to 10 are diagrammatic fragmentary axial section views showing another embodiment of the invention.

FIG. 1 shows a packaging and applicator device comprising an endpiece 11 for applying substance, a body 18 defining a reservoir 12 containing a cosmetic or a care product P, and a mechanism 13 enabling a quantity of the substance to be dispensed.

By way of example, the viscosity of the substance P can lie in the range 0.6 Pascal seconds (Pa.s) to 17 Pa.s.

The endpiece 11 comprises a first part or base 14 having a second part or grid 15 fitted thereto, in a manner explained below.

The above-mentioned mechanism 13 has a threaded rod 17 that turns in a bore in the body 18 and that is suitable for being turned by means of a drive knob 19 situated at the bottom of the device 10.

A piston 20 meshes with the rod 17 and can move in translation in contact with the body 18 while being prevented from rotating relative thereto so that turning the knob 19 causes the piston 20 to move axially, thereby serving to expel a quantity of substance through a passage 30 provided at the top of the body 18.

The base 14 of the endpiece 11 in this example is made integrally with the body 18 by molding a relatively rigid plastics material, and it includes a tubular skirt 23 surrounding a housing 24 in which the grid 15 is fixed.

It is thus the base 14 through which the grid 15 is fed with substance.

The grid 15 can be fixed onto the base 14 in various different ways without going beyond the ambit of the present invention.

For example, as shown in the drawing, this can be done by means of a projection 26 formed on the grid 15 which snap-fastens in leakproof manner in a complementary annular groove formed in the inside surface of the skirt 23.

In the example described, the grid 15 has a central region 15*a* and a peripheral region 15*b* that are interconnected by bridges of material 15*c*.

The regions 15*a* and 15*b* leave between them an annular groove 25 across which the bridges 15*c* extend, which bridges leave passages between one another via which the substance can pass through the grid 15.

On its outside face 27, the grid 15 has a coating of flocking 28, which coating covers the side surfaces 25*a* and 25*b* of the grid 15 defining the groove 25 over a fraction of their height, as can be seen in FIG. 2.

In this case, the outside face 27 is plane and extends obliquely relative to the axis X of the rod 17, such that the endpiece 11 presents a generally chamfered shape.

In the example described, the bridges 15*c* are set back from the outside surface 27 and the coating of flocking 28 covers the side surfaces 25*a* and 25*b* over a height that is less than the distance between the outside face 27 and the bridges 15*c*.

To make the coating of flocking 28, the grid 15 is coated in adhesive on its outside face 27 by being immersed completely or in part by a bath of adhesive, and then bristles are deposited electrostatically onto those regions of the grid 15 that have been thus coated in adhesive.

The adhesive used is selected to present viscosity and surface tension which avoid films forming across the openings through the grid 15 so as to ensure that they are not closed.

The diameters, lengths, and natures of the bristles can be various or they can be substantially identical, depending on the substance that is to be applied.

By way of example, the bristles can be made in particular of polyamide, rayon, polyester, viscose, or cotton.

The length of the bristles can be 0.5 mm, or longer, for example.

The coating of flocking covers the outside edge of the grid 15 over a certain height, as can be seen in FIG. 3.

The grid 15 is fed with substance via the above-mentioned passage 30, which puts the housing 24 into communication with the inside of the reservoir 12.

This passage 30 opens out via an orifice 30*a* in the bottom of the housing 24 in register with a bottom region 25*c* of the groove 25.

As a result, when the user turns the knob 19, the substance begins to be expelled via the bottom region 25*c* of the annular groove 25, as shown in FIG. 4, even though a gap 33 can exist between the grid 15 and the bottom of housing 24.

Thus, the user can cause a drop G of the substance P to be delivered in a non-central location of the outside face 27, as shown in FIG. 5.

In this case, the drop G is situated in the bottom region of the outside face 27.

Since the annular groove 25 is filled only partially with the substance when the substance is expelled via the bottom region 25*c*, the top region 25*d* can absorb substance while it is being spread over the applicator surface, as shown in FIG. 6.

The fact that the substance P is expelled onto the outside face 27 in localized manner enables the user to control accurately, prior to application, how much substance is going to be loaded on the outside face 27.

Furthermore, the risk of the substance being in excess on the applicator surface is reduced because of the substance-absorption capacity of those regions of the annular groove 25 that are remote from the region through which the substance is delivered.

The gap 33 can be chosen to be large enough to allow a certain amount of substance to circulate under the grid 15.

Circulation of the substance from the passage 30 towards the region 25*c* of the grove 25 and within said region tends, providing the substance is moving fast enough, to establish an effect whereby the substance contained in the gap 33 is entrained and sucked out, so that this substance is mixed with the substance that is being delivered to the region 25*c*, thereby serving to empty the region 25*d*, at least in part.

Thus, on each new delivery of substance from the reservoir 12, the region 25*d* can accept some of the substance that is present in excess on the applicator surface, should that be necessary.

Furthermore, causing the substance to circulate helps prevent any substance remaining for too long a time in the endpiece without being used, thereby preventing deterioration thereof.

The width of the groove 25 is preferably selected in such a manner that the surface of the skin or of the mucous membranes in contact with the endpiece 11 at the time substance is applied can deform slightly and dip into any substance that might be contained in the groove, as shown in FIG. 7.

In the example described, it will be observed that the coating of flocking 28 extends to the peripheral edge 28*a* of the grid 15, said edge 28*a* being substantially in contact with the non-flocked top end of the skirt 23, thus making it possible to obtain flocking having an outline that is sharp when seen from the outside.

It will also be observed that the risk of the passage feeding the applicator surface being blocked by the coating of flocking is reduced, given the relatively large dimensions of the annular groove 25 and the fact that the orifice 30*a* is not exposed to the adhesive used for applying flocking to the grid 15.

Naturally, it is possible to use an endpiece having configurations that are different without going beyond the ambit of the present invention.

Figure 9:
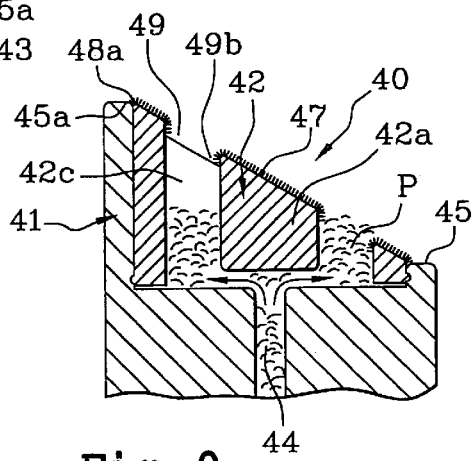
Figure 10:
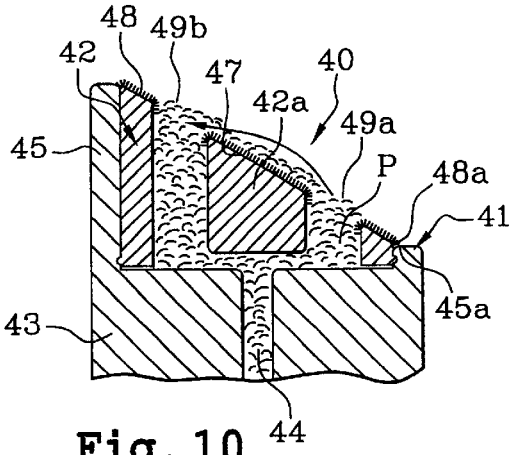

By way of example, FIGS. 8 to 10 show an endpiece 40 comprising a support part or base 41 associated with a fitted element or grid 42.

The support part 41 comprises a bottom portion 43 through which a central passage 44 passes that is in communication with the reservoir containing the substance, and a top portion 45 serving to define a housing 46 in which the fitted part 42 is secured.

This top part 45 is in the form of a tubular skirt of varying height, the top end of this tubular skirt being substantially tangential to a plane that is inclined relative to the axis of the endpiece.

The fitted part 42 has an outside face 47 for defining an applicator surface, which outside face is covered in a coating of flocking 48.

The endpiece 40 is generally chamfered in shape.

The fitted part 42 has a central portion 42*a* and a peripheral portion 42*b* which are interconnected by bridges of material 42*c*, like the above-described grid 15.

The fitted portion 42 is secured in the housing 46 by snap-fastening, as in the preceding embodiment.

The central portion 42*a* co-operates with the peripheral portion 42*b* to define an annular groove 49.

The coating of flocking 48 extends somewhat into the annular groove 49, covering the edges of the portions 42*a* and 42*b* on either side of said groove.

While substance is being dispensed, the substance is expelled in privileged manner via the bottom region 49*a* of the groove 49 because that is where the groove is of smaller height, as can be seen in FIG. 9.

The top region 49*b* of the groove 49 serves to recover any excess substance that might be found on the applicator surface 47, as shown in FIG. 10.

The central portion 42*a* acts as a jet-deflector given its position facing the passage 44.

The coating of flocking 48 extends to a peripheral edge 48*a* of the fitted part 42 which is substantially in contact with the non-flocked top end 45*a* of the tubular skirt 45.

Figure 11:
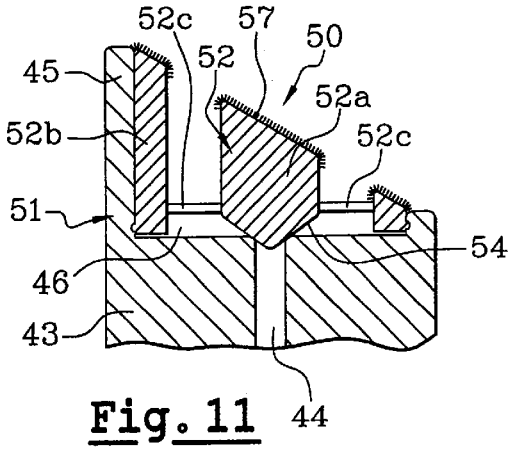
FIG. 11 is a fragmentary diagrammatic axial section view showing a variant embodiment.

FIG. 11 is a view analogous to the view of FIGS. 8 to 10, and it shows an endpiece 50 having a support part 51 identical to the support part 41 as described above, together with a fitted part 52.

The fitted part 52 has a central portion 52*a* and a peripheral portion 52*b* that are interconnected by bridges of material 52*c*.

The outside face 57 of the fitted part 52 defines an applicator surface.

The peripheral portion 52*b* is identical to the peripheral portion 42*b* as described above and it is fixed in the same manner to the support part 51.

The bottom of the central portion 52*a* presents a shutter-forming portion 54 which, in the rest state, presses against the bottom of the housing 46 so as to shut the passage 44 and the communication between the housing 46 and the supply of substance.

This serves to isolate the supply from ambient air except while the endpiece is being fed with substance.

The bridges 52*c* are made in such a manner as to leave a certain amount of freedom to the central portion 52*a* to move under the effect of pressure from the substance in the passage 44.

The shutter-forming portion 54 is shaped like a center punch so that when it moves away from the bottom of the housing 46, it leaves a passage for the substance to flow towards the applicator surface.

FIGS. 12 to 17 show various endpiece configurations so as to demonstrate that the invention is not limited to the two configurations described above.

Figure 12:
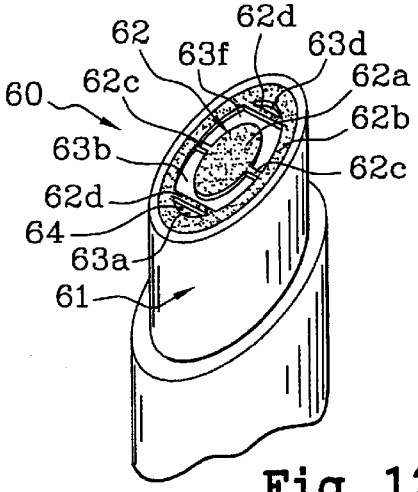
FIGS. 12 to 17 are diagrammatic perspective views showing various endpiece shapes.

Thus, FIG. 12 shows an endpiece 60 having a support part or base 61 which in this case is identical to the support part 14 described above, and a grid or fitted part 62 having a central portion 62*a* and a peripheral portion 62*b* united by bridges 62*c*.

The grid 62 has bottom and top bars 62*d* parallel to the bridges 62*c*.

The grid 62 defines a plurality of cavities 63*a*, 63*b*, 63*c*, and 63*d*, with the bottoms of the cavities being set back from the applicator surface.

The cavity 63*a* is formed between the peripheral portion 62*b* and the bottom bar 62*d*.

The cavity 63*b* is formed between the peripheral portion 62*b*, the bottom bar 62*d*, and the central portion 62*a*.

The cavity 63*c* is formed between the central portion 62*a*, the top bar 62*d*, and the peripheral portion 62*b*.

The cavity 63*d* is formed between the top bar 62*d* and the peripheral portion 62*b*.

An orifice 64 opens out into the bottom of the housing receiving the grid 62 in order to feed the applicator surface with substance.

In the example described, this orifice 64 opens out into the above-mentioned cavity 63*a*.

All of the cavities 63*a* to 63*d* communicate with one another beneath the grid 62.

Excess substance present on the applicator surface can be recovered by one of the cavities 63*b* to 63*d* in a manner similar to that which occurs in the above-described embodiments.

The entire outside face of the grid 62 is covered by a coating of flocking, which extends as far as the annular non-flocked skirt of the base 61 which surrounds the grid 62.

Figure 13:
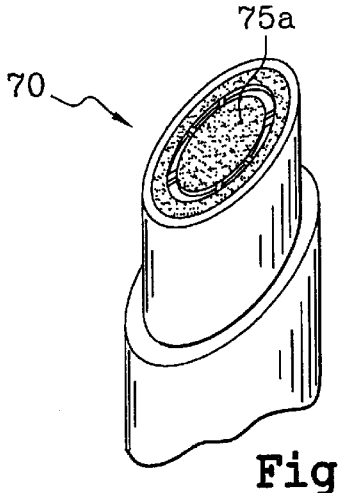

FIG. 13 shows an endpiece 70 which differs from the endpiece shown in FIG. 5 mainly by the fact that the central portion 15*a* is replaced by a central portion 75*a* of larger diameter, which occupies a larger fraction of the applicator surface.

The outline of the grid where it joins the support part need not be circular.

Figure 15:
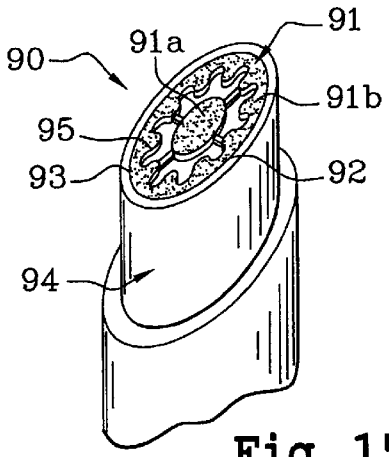

By way of example, FIG. 15 shows an endpiece 80 having a grid 81 fixed on a supporting part 82.

The support part 82 has a chamfered front face 83 and a housing opening out into said front face to receive the grid 81.

Figure 14:
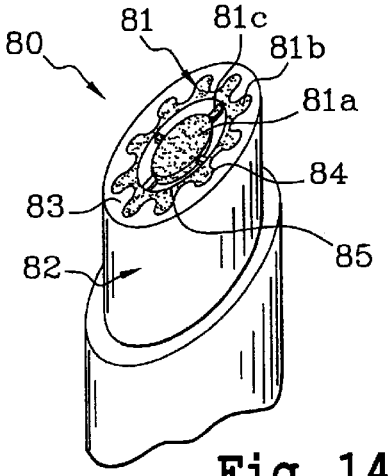

In FIG. 14, it can be seen that the grid 81 comprises a central portion 81*a* and a peripheral portion 81*b* interconnected by bridges of material 81*c*, the peripheral portion 81*b* having a coating of flocking as far as an edge 84 which presents undulations and which is situated in contact with a non-flocked corresponding edge 85 of complementary shape of the front face 83.

FIG. 15 shows an endpiece 90 that comprises a support part receiving a grid 91 having a central portion 91*a* and a peripheral portion 91*b*.

The peripheral portion 91*b* has a coating of flocking as far as its radially outer edge 92, which edge is in contact with the non-flocked edge 93 of the support part 94.

The peripheral portion 91*b* has an undulating edge 95 surrounding the central portion 91*a*.

Figure 16:
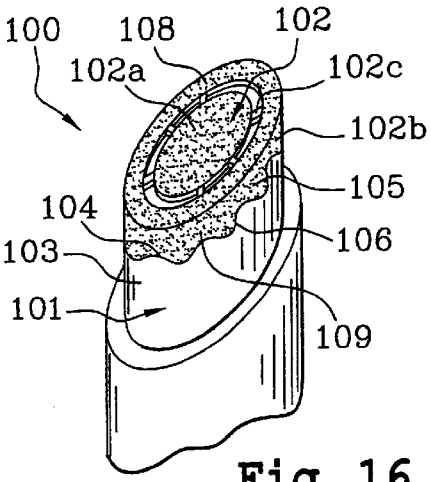

FIG. 16 shows an endpiece 100 having a support part 101 and a fitted part 102, the fitted apart having a central portion 102*a* and a peripheral portion 102*b* interconnected by bridges of material 102*c*.

The support part 101 has a tubular skirt 103 whose top edge 104 presents undulations.

The fitted part 102 also has a tubular skirt 105 whose bottom edge 106 presents a shape that is complementary to that of the edge 104, such that the two edges 104 and 106 come fully into contact with each other, as shown in FIG. 16.

The fitted part 102 has a coating of flocking both on its front face 108 and on its side surface 109.

This coating of flocking extends as far as the edge 106 and comes into contact with the non-flocked edge 104 of the support part.

The endpiece can be given yet other shapes.

The side surface of the endpiece need not be circularly symmetrical.

Figure 17:
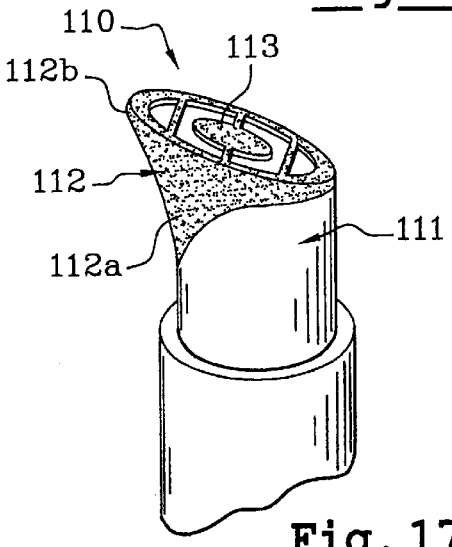

By way of example, FIG. 17 shows an endpiece 110 which has a support part 111 and a fitted part 112, the fitted part comprising a bottom portion 112*a* which comes into contact with the support part 111 and an offset portion 112*b* which is eccentric relative to the axis of the support part 111.

The fitted part 112 presents a top face 113 forming a chamfer. The entire outside surface of the fitted part 112 has a coating of flocking.

This coating of flocking extends to the non-flocked top edge of the support part 111.

The substance can be packaged and the applicator surface can be fed with substance in various other ways.

Thus, the piston and drive screw reservoir shown in FIG. 1 can be replaced by a reservoir having a deformable wall, as shown in FIG. 18.

This figure shows a packaging and applicator device 120 comprising an endpiece 121 identical to the endpiece 11 as described above, and a reservoir constituted by a compressible tube 122.

In this case, the base of the endpiece 121 is integrally formed with the tube, but in a variant it could itself be constituted by an element which is fitted to the tube.

As shown in FIG. 19, it is also possible to use a pump for feeding the applicator surface with substance.

In this figure, there can be seen a device 130 comprising a body 134 surmounted by an endpiece 131 carrying a grid 132 similar to the grid 42 described with reference to FIGS. 8 to 10, comprising an annular groove 153 and a support part 133 fixed on the body 134.

The bottom end 135 of the body 134 is open to receive a refill 136 comprising a reservoir 137 containing substance and a pump 138 having a hollow control rod 139.

The rod 139 is forced into a housing 140 situated in the top proton of the body 134.

This housing 140 communicates via a passage 141 with the bottom of the housing 142 in the support part 133 in which the grid 132 is fixed.

While the pump 138 is at rest, the refill 136 projects beyond the bottom of the body 134.

By pressing on the bottom 144 of the reservoir 137, the user can urge the refill 136 towards the top portion 145 of the body 134, thereby actuating the rod 139 and causing a quantity of substance to be dispensed.

The substance leaving the top end of the rod 139 fees the applicator surface in a manner similar to that described with reference to FIGS. 8 to 10.

Advantageously, and as shown in FIG. 20, the device 130 has a closure cap 151 suitable for being fixed in sealed manner on the body 134 by snap-fastening for example, and comprising a bottom skirt 148 whose bottom edge 150 is suitable for engaging in the annular groove 153 so as to prevent any substance escaping and so as to protect any substance that may be present beneath the grid 132 and in the groove 153 from making contact with ambient air.

Although it is preferable for the surface that is used to apply the substance to be chamfered in order to make it easier to apply the substance and obtain neat makeup, it would not go beyond the ambit of the present invention for the applicator surface to extend perpendicularly to the axis of the support part.

The support part and the grid can be made in numerous ways without going beyond the ambit of the present invention.

In particular, the jet-deflector can be formed integrally with the support part.

It is also possible to make the endpiece with a grid having an outside face that is outwardly convex, as shown in FIG. 21, or outwardly concave, as shown in FIG. 22.

It is also possible to make an endpiece whose grid is completely covered in flocking, as shown in FIG. 23. In this figure, it can be seen that the coating of flocking extends over the outside face of the endpiece as far as the top peripheral edge 155 of the grid, and that this edge comes substantially into contact with the corresponding non-flocked edge 156 of the support part that receives the grid.

It is also possible to make the endpiece with a grid that is flocked or not flocked over a fraction only of its outside surface.

Naturally, the invention is not limited to the embodiments described above.

In particular, the shape of the base or support part, and the shape of the fitted part or grid could be further modified without going beyond the ambit of the present invention.

In particular, the various characteristics of the embodiment described above can be combined with one another.

The second part of the endpiece can be made out of flocked foam, for example.

What is claimed is:

1. A device for packaging and applying a cosmetic or care product, the device comprising:

a reservoir containing the product, said reservoir having a longitudinal axis, an applicator endpiece having an applicator surface, said applicator endpiece being in fluid communication with said reservoir and defining a gap region between said applicator surface and said reservoir, said applicator endpiece having therein an endless groove in fluid communication without any one-way valve with said reservoir and with said gap region, said endless groove being co-axial with the longitudinal axis, at least one orifice defined between said endpiece and said reservoir, and conveying the product from said reservoir to said endpiece, said orifice being offset with respect to the longitudinal axis such that at least during a first filling operation, a first portion of said groove is filled with said product from said orifice prior to a filling of a second portion of said groove with said product.

2. The device of claim 1, further comprising a dispensing mechanism coupled to said reservoir.

3. The device of claim 2, wherein said dispensing mechanism comprising a piston and a drive element driving said piston along said longitudinal axis to dispense the product towards said applicator endpiece.

4. The device of claim 3, wherein said drive element is a rotary knob.

5. The device of claim 2, wherein said dispensing mechanism is a pump.

6. The device of claim 2, wherein said dispensing mechanism is a flexible wall forming said reservoir.

7. The device of claim 9, wherein said reservoir and said applicator endpiece are separably attached.

8. The device of claim 7, wherein said reservoir is removably attached to said applicator endpiece such that said reservoir can be replaced.

9. The device of claim 1, wherein said applicator endpiece and said reservoir are integrally formed.

10. The device of claim 1, wherein said applicator surface is disposed at an oblique angle in relation to said longitudinal axis and having an upper and a lower region.

11. The device of claim 1, wherein said applicator surface is flocked.

12. The device of claim 1, wherein at least a portion of said endless groove is flocked.

13. The device of claim 11, wherein said portion includes an area closest to said applicator surface.

14. The device of claim 10, wherein said orifice is situated in said lower region of said oblique surface.

15. The device of claim 14, wherein the distance between said orifice and said applicator surface is shorter in said lower region than said upper region.

16. The device of claim 10, wherein said first portion of said groove is located in said lower region and said second portion of said groove is located in said upper region.

17. The device of claim 1, wherein said gap region is in fluid communication with said first and second portions of said groove and the product is recirculated between said first and second portions of said groove through said gap region.

18. The device of claim 1, wherein said groove has a varying height along said longitudinal axis.

19. The device of claim 1, wherein said groove has a width effective to enable lips or skin to come into contact with the product contained within said groove.

20. The device of claim 1, wherein said applicator endpiece includes a base and a grid defining said gap region therebetween, said grid having a central region and a peripheral region forming said groove therebetween.

21. The device of claim 20, wherein said central and peripheral regions are interconnected by a plurality of bridges.

22. The device of claim 21, wherein said bridges are recessed from said applicator surface within said endless groove.

23. The device of claim 21, wherein surface of said central and peripheral regions are flocked.

24. The device of claim 23, wherein said flocking extends below the surface into said endless groove.

25. The device of claim 21, wherein said flocking extends around the periphery of said peripheral region.

26. The device of claim 20, wherein said base and said grid are integrally formed.

27. The device of claim 21, wherein said base and said grid are separably attached.

28. The device of claim 21, wherein said central and peripheral regions are of uniform height along their width.

29. The device of claim 21, wherein said central and peripheral regions are of varying height along their width.

30. The device of claim 20, wherein said grid has a convex applicator surface.

31. The device of claim 20, wherein said grid has a concave applicator surface.

32. The device of claim 20, wherein said grid further comprising a shutter element integrally formed with said central region, and said shutter element is resiliently biased against said orifice to form a check valve.

33. The device of claim 32, wherein said shutter element is moved away from said orifice under pressure of the product being dispensed.

34. The device of claim 1, further comprising a closure for sealing said endpiece from ambient.

35. The device of claim 34, wherein said closure has a skirt extending along said longitudinal axis towards said applicator surface.

36. The device of claim 35, wherein said skirt cooperates with said endless groove and seals said groove from ambient.

37. A device for dispensing a product, comprising:

a reservoir body containing said product, said reservoir body defining at least one axial orifice oriented along an orifice axis parallel to a longitudinal axis of said reservoir body, said orifice axis being offset from said longitudinal axis; and an applicator endpiece coupled to said reservoir body, wherein said applicator endpiece has an applicator surface and defines a groove in communication without any one-way valve with said axial orifice, said groove having a first portion and a second portion, said first and second portions being disposed relative to said axial orifice so that at least during a first filling operation, said first portion is filled with said product from said orifice prior to the filling of said second portion with said product.

38. The device of claim 37, wherein said applicator surface includes at least one chamfered portion.

39. The device of claim 37, wherein said applicator endpiece is covered with a flock coating in said groove.

40. The device of claim 37, wherein said applicator surface is covered with a flock coating.

41. A device according to claim 37, wherein said axial axis passes through said first portion.

42. A device according to claim 41, wherein said groove communicates with said applicator surface via a plurality of openings and said axial axis passes through one of said openings.

43. A device according to claim 42, wherein the applicator surface has at least one chamfered portion, and wherein said axis passes through said first portion at a bottom region of said chamfered portion.

44. A device according to claim 37, wherein said applicator endpiece comprises a solid portion facing said axial orifice.

45. A device according to claim 37, wherein said first portion of said groove is closer to said axial orifice than said second portion of said groove is to said axial orifice.

46. A device according to claim 37, wherein said reservoir body defines only one orifice.

47. A device according to claim 37, wherein said groove is large enough to enable a surface of lips or of skin to come into contact at a time of application with said product inside said groove.

48. A device according to claim 37, wherein said groove is more than 1 mm wide.

49. A device according to claim 37, wherein the applicator surface has no relief portions.

50. A device according to claim 37, wherein said applicator endpiece is coupled to said reservoir body so as to define a gap between said applicator endpiece and an outer surface of said reservoir body, said gap being in communication with said axial orifice and with said groove.

51. A device according to claim 37, wherein said applicator endpiece comprises:

a dispensing part defining said groove, and a skirt coupled to said dispensing part and to said reservoir body.

52. A device according to claim 51, wherein said skirt is coupled to said dispensing part so as to define a gap between said skirt and said dispensing part, said gap being in communication with said axial orifice and with said groove.

53. A device according to claim 37, wherein said applicator endpiece is at least partially covered with a flock coating which extends to an edge in contact with a non-flocked edge of the reservoir body.

54. A device according to claim 53, wherein said applicator endpiece comprises a non-flocked annular outer skirt.

55. A device according to claim 54, wherein said applicator endpiece comprises a grid coupled to said outer skirt.

56. A device according to claim 55, wherein said applicator endpiece comprises a solid portion facing said axial orifice.

57. A device according to claim 37, wherein said groove is annular and extends around a closed curve.

58. A device according to claim 37, wherein said applicator endpiece has an interior surface facing said reservoir body, and said groove has a constant width between said applicator surface and said interior surface.

59. A device according to claim 37, wherein said applicator endpiece comprises a check valve movable by pressure generated by said product.

60. A device according to claim 37, wherein said applicator endpiece and said reservoir body are made of different materials.

61. A device according to claim 37, wherein the applicator surface comprises a chamfered surface and a side surface extending around the chamfered surface, said chamfered and side surfaces both being flocked.

62. A device according to claim 37, further comprising a piston for applying pressure on the product contained in the reservoir body in order to dispense the product.

63. A device according to claim 37, wherein said reservoir body comprises a compressible wall enabling the product to be dispensed by exerting pressure on the compressible wall.

64. A device according to claim 37, further comprising a pump for said product out of said orifice.

65. A device according to claim 64, wherein said applicator endpiece comprises a body coupled to said reservoir body and wherein said pump is actuated by moving said reservoir body relative to said body.

66. A device according to claim 37, wherein the reservoir body is removable from said applicator endpiece.

67. A device according to claim 37, further comprising a closure cap having at least one internal shutter element which covers the groove when said closure cap is on said applicator endpiece.

68. A device for dispensing a product, comprising:

a reservoir body containing said product, said reservoir body defining at least one orifice at an end of said reservoir body; and an applicator endpiece disposed at said end of said reservoir body, wherein said applicator endpiece defines a groove in direct two-way communication with said orifice without any one-way valve between the groove and the orifice, said groove having a first portion and a second portion positioned relative to said orifice so that at least during a first filling operation, said first portion is filled with said product from said orifice prior to the filling of said second portion with said product.

69. A device according to claim 68, wherein said applicator endpiece is disposed on said reservoir body so as to define a gap between said applicator endpiece and an outer surface of said reservoir body, said gap being in communication with said orifice and with said groove.

70. A device according to claim 68, wherein said applicator endpiece has an applicator surface and said groove communicates with said applicator surface over an entire length of said groove.

71. A device according to claim 68, wherein said applicator endpiece has an applicator surface and said groove communicates with said applicator surface via a plurality of discrete openings.

72. A device for dispensing a product, comprising:

a reservoir body containing said product, said reservoir body defining at least one orifice at an end of said reservoir body, said end having an outer surface; and an applicator endpiece disposed at said end of said reservoir body and covering at least a portion of said outer surface, wherein said applicator endpiece has an applicator surface parallel to said outer surface; said applicator endpiece defining a groove in communication with said orifice, said groove having a first portion and a second portion disposed relative to said orifice so that at least during a first filling operation said first portion is filled with said product from said orifice prior to the filling of said second portion with said product.

73. The device of claim 72, wherein said application endpiece is coated with a flock coating covering said application surface and extending into said groove.

74. The device of claim 72, wherein said applicator endpiece comprises a solid portion facing said orifice.

75. A device according to claim 72, wherein said applicator endpiece is disposed on said reservoir body so as to define a gap between said applicator endpiece and said outer surface of said reservoir body, said gap being in communication with said orifice and with said groove.

76. A device for dispensing a product, comprising:

a reservoir body containing said product, said reservoir body defining at least one orifice; and an applicator endpiece coupled to said reservoir body, wherein said applicator endpiece has an applicator surface and an interior surface facing said reservoir body, said applicator surface and said interior surface being parallel to each other, and wherein said applicator endpiece defines a groove in communication without any one-way valve with said orifice, said groove having a first portion and a second portion, said first portion being closer to said orifice than said second portion is to said orifice.

77. A device according to claim 76, wherein said applicator endpiece is coupled to said reservoir body so as to define a gap between said applicator endpiece and an outer surface of said reservoir body, said gap being in communication with said orifice and with said groove.

78. A device for dispensing a product, comprising:

a reservoir body defining at least one orifice; and an applicator endpiece coupled to said reservoir body, wherein said applicator endpiece has an applicator surface being fed with product through at least one passage extending through said applicator endpiece, said passage opening out both on said applicator surface and on an interior surface facing the reservoir body by at least one oblong groove, wherein the device is free of a one-way valve, and wherein said groove has a first portion and a second portion, said first portion being closer to said orifice than said second portion is to said orifice.

79. A device according to claim 78, further comprising bridges across said groove of constant width.

80. A device according to claim 78, wherein said applicator endpiece is coupled to said reservoir body so as to define a gap between said applicator endpiece and an outer surface of said reservoir body, said gap being in communication with said orifice and with said groove.

81. A device for dispensing a product, comprising:

a reservoir body defining at least one orifice; and an applicator endpiece disposed on said reservoir body, wherein said applicator endpiece defines a groove in communication without any one-way valve with said orifice, and said groove having a first portion and a second portion configured so that at least during a first filling operation said first portion is filled with said product prior to said second portion being filled with said product, and wherein said applicator endpiece has an applicator surface, said applicator endpiece being coated with a flock coating which covers at least part of said applicator surface.

82. A device according to claim 81, wherein said flock coating extends into said groove.

83. A device according to claim 82, wherein said reservoir has an annular skirt coupled to said applicator endpiece, said annular skirt contacting a surface of said applicator endpiece which is coated with said flock coating.

84. A device according to claim 82, wherein said applicator endpiece is coupled to said reservoir body so as to define a gap between said applicator endpiece and an outer surface of said reservoir body, said gap being in communication with said orifice and with said groove.

85. The device of claim 84, wherein said flock coating extends into said gap.

86. The device of claim 85, wherein said flock coating covers all surfaces of said applicator endpiece.

87. A device for dispensing a product, comprising:

a reservoir body containing said product, said reservoir body defining at least one orifice at an end of said reservoir body; and an applicator endpiece disposed at said end of said reservoir body so as to define a gap between said applicator endpiece and said reservoir body, said gap being in communication without any one-way valve with said orifice, wherein said applicator endpiece defines a groove in communication without any one-way valve with said gap, said groove having a first portion and a second portion, said first portion being closer to said orifice than said second portion is to said orifice.

88. A device for dispensing a product, comprising:

a reservoir body containing said product, said reservoir body defining at least one orifice oriented along an orifice axis parallel to a longitudinal axis of said reservoir body, said orifice axis being offset from said longitudinal axis;

an applicator endpiece coupled to said reservoir body, wherein said applicator endpiece has an applicator surface and defines a groove in communication without any one-way valve with said orifice;

a dispensing part defining said groove; and a skirt coupled to said dispensing part and to said reservoir body.

89. A device for dispensing a product comprising:

a reservoir body containing said product, said reservoir body defining at least one orifice at an end of said reservoir body;

an applicator endpiece disposed at said end of said reservoir body so as to define a gap between said applicator endpiece and said reservoir body, said gap being in communication without any one-way valve with said orifice and extending in a plane transverse to an axis of said orifice;

at least one groove extending through said applicator endpiece from said gap to an applicator surface disposed on an exterior of said device, and wherein said at least one groove extends from said gap to said applicator surface in a direction transverse to said plane.

90. A device as recited in claim 89, wherein said at least one groove includes a first portion and a second portion, and wherein said first portion is disposed closer to said orifice than said second portion.

91. A device as recited in claim 90, wherein said orifice is offset from a center of said gap.

92. A device as recited in claim 91, wherein said at least one groove is symmetrically positioned with respect to the center of said gap.

93. A device as recited in claim 91, wherein a width of said at least one groove is larger than a spacing between said reservoir body and said endpiece corresponding to a width of said gap.

94. A device for dispensing a product, comprising:

a reservoir body defining at least one orifice, and an applicator endpiece disposed on said reservoir body, wherein said applicator endpiece defines a groove in communication without any one-way valve with said orifice, said applicator endpiece having an applicator surface, said applicator endpiece being coated with a flock coating which covers at least part of said applicator surface.

95. A device as recited in claim 94, wherein said applicator endpiece includes a skirt which extends from said applicator surface, and wherein said flock coating extends onto said skirt.

96. A device as recited in claim 95, wherein said flock coating extends into said groove.

97. A device as recited in claim 95, wherein said skirt is cylindrical and said applicator surface is in a plane oriented at an angle with respect to a longitudinal axis of said skirt, said angle being other than a right angle.

98. A device for packaging and applying a cosmetic or care product, the device comprising:

a reservoir containing the product, said reservoir having a longitudinal axis, an applicator endpiece having an applicator surface, said applicator endpiece being in fluid communication with said reservoir and defining a gap region between said applicator surface and said reservoir, said applicator endpiece having therein an endless groove in fluid communication with said reservoir and with said gap region, said endless groove being co-axial with the longitudinal axis, at least one orifice defined between said endpiece and said reservoir, and conveying the product from said reservoir to said endpiece, said orifice being offset with respect to the longitudinal axis, wherein said applicator surface is disposed at an oblique angle in relation to said longitudinal axis and has an upper and lower region, said orifice being situated in said lower region.

99. The device of claim 98, wherein the distance between said orifice and said applicator surface is shorter in said lower region than said upper region.

100. The device of claim 98, wherein said endless groove has a first portion and a second portion, said first and second portion being disposed relative to said axial orifice so that at least during a first filling operation, said first portion is filled with said product from said orifice prior to a filling of said second portion with said product.

101. A device for packaging and applying a cosmetic or care product, the device comprising:

a reservoir containing the product, said reservoir having a longitudinal axis, an applicator endpiece having an applicator surface, said applicator endpiece being in fluid communication with said reservoir and defining a gap region between said applicator surface and said reservoir, said applicator endpiece having therein an endless groove in fluid communication with said reservoir and with said gap region, said endless groove being co-axial with the longitudinal axis, a closure for sealing said endpiece from ambient, said closure having a skirt extending along said longitudinal axis towards said applicator surface, said skirt co-operating with said endless groove and sealing said groove from ambient, at least one orifice defined between said endpiece and said reservoir, and conveying the product from said reservoir to said endpiece, said orifice being offset with respect to the longitudinal axis.

102. The device of claim 101, wherein said endless groove has a first portion and a second portion, said first and second portion being disposed relative to said axial orifice so that at least during a first filling operation, said first portion is filled with said product from said orifice prior to a filling of said second portion with said product.

103. A device for dispensing a product, comprising:

a reservoir body containing said product, said reservoir body defining at least one axial orifice oriented along an orifice axis parallel to a longitudinal axis of said reservoir body, said orifice axis being offset from said longitudinal axis; and an applicator endpiece coupled to said reservoir body, wherein said applicator endpiece has an applicator surface and defines a groove in communication with said axial orifice, said applicator surface being covered with a flock coating in said groove.

104. The device of claim 103, wherein said groove has a first portion and a second portion, said first and second portions being disposed relative to said axial orifice so that at least during a first filling operation, said first portion is filled with said product from said orifice prior to a filling of said second portion with said product.

105. A device for dispensing a product, comprising:

a reservoir body containing said product, said reservoir body defining at least one axial orifice oriented along an orifice axis parallel to a longitudinal axis of said reservoir body, said orifice axis being offset from said longitudinal axis; and an applicator endpiece coupled to said reservoir body, wherein said applicator endpiece has an applicator surface and defines a groove in communication with said axial orifice, said groove having a first portion and a second portion, said first and second portions being disposed relative to said axial orifice so that at least during a first filling operation, said first portion is filled with said product from said orifice prior to a filling of said second portion with said product, said first portion of said groove being closer to said orifice than said second portion of said groove is to said orifice.

106. A device for dispensing a product, comprising:

a reservoir body containing said product, said reservoir body defining at least one axial orifice oriented along an orifice axis parallel to a longitudinal axis of said reservoir body, said orifice axis being offset from said longitudinal axis; and an applicator endpiece coupled to said reservoir body, wherein said applicator endpiece has an applicator surface and defines a groove in communication with said axial orifice, said applicator endpiece being at least partially covered with a flock coating which extends to an edge in contact with a non-flocked edge of the reservoir body, said applicator endpiece comprising a non-flocked annular outer skirt and a grid coupled to said outer skirt.

107. The device of claim 106, wherein said groove has a first portion and a second portion, said first and second portions being disposed relative to said axial orifice so that at least during a first filling operation, said first portion is filled with said product from said orifice prior to a filling of said second portion with said product.

108. A device according to claim 106, wherein said applicator endpiece comprises a solid portion facing said axial orifice.

109. A device for dispensing a product, comprising:

a reservoir body containing said product, said reservoir body defining at least one axial orifice oriented along an orifice axis parallel to a longitudinal axis of said reservoir body, said orifice axis being offset from said longitudinal axis; and an applicator endpiece coupled to said reservoir body, wherein said applicator endpiece has an applicator surface and defines a groove in communication with said axial orifice, said applicator endpiece having an interior surface facing said reservoir body, and said groove having a constant width between said applicator surface and said interior surface.

110. The device of claim 109, wherein said groove has a first portion and a second portion, said first and second portions being disposed relative to said axial orifice so that at least during a first filling operation, said first portion is filled with said product from said orifice prior to the filling of said second portion with said product.

111. A device for dispensing a product, comprising:

a reservoir body containing said product, said reservoir body defining at least one axial orifice oriented along an orifice axis parallel to a longitudinal axis of said reservoir body, said orifice axis being offset from said longitudinal axis; and an applicator endpiece coupled to said reservoir body, wherein said applicator endpiece has an applicator surface and defines a groove in communication with said axial orifice and wherein said applicator surface comprises a chamfered surface and a side surface extending around the chamfered surface, said chamfered and side surfaces both being flocked.

112. The device of claim 111, wherein said groove has a first portion and a second portion, said first and second portions being disposed relative to said axial orifice so that at least during a first filling operation, said first portion is filled with said product from said orifice prior to a filling of said second portion with said product.

113. A device for dispensing a product, comprising:

a reservoir body containing said product, said reservoir body defining at least one axial orifice oriented along an orifice axis parallel to a longitudinal axis of said reservoir body, said orifice axis being offset from said longitudinal axis; and an applicator endpiece coupled to said reservoir body, wherein said applicator endpiece has an applicator surface and defines a groove in communication with said axial orifice, said device further comprising a closure cap having at least one internal shutter element which covers the groove when said closure cap is on said applicator endpiece.

114. The device of claim 113, wherein said groove has a first portion and a second portion, said first and second portions being disposed relative to said axial orifice so that at least during a first filling operation, said first portion is filled with said product from said orifice prior to a filling of said second portion with said product.

115. A device for dispensing a product, comprising:

a reservoir body containing said product, said reservoir body defining at least one orifice at an end of said reservoir body; and an applicator endpiece disposed at said end of said reservoir body, wherein said applicator endpiece defines a groove in direct two-way communication with said orifice, said applicator endpiece has an applicator surface and said groove communicating with said applicator surface via a plurality of discrete openings.

116. The device of claim 115, wherein said groove has a first portion and a second portion positioned relative to said orifice so that at least during a first filling operation, said first portion is filled with said product from said orifice prior to a filling of said second portion with said product.

117. A device for dispensing a product, comprising:

a reservoir body defining at least one orifice; and an applicator endpiece coupled to said reservoir body, wherein said applicator endpiece has an applicator surface being fed with product through at least one passage extending though said applicator endpiece, said passage opening out both on said applicator surface and on an interior surface facing the reservoir body by at least one oblong groove, and said device further comprising bridges across said groove of constant width.

118. The device of claim 117, wherein said groove has a first portion and a second portion, said first portion being closer to said orifice than said second portion is to said orifice.

119. A device for dispensing a product, comprising:

a reservoir body defining at least one orifice; and an applicator endpiece disposed on said reservoir body, wherein said applicator endpiece defines a groove in communication with said orifice, wherein said applicator endpiece has an applicator surface, said applicator endpiece being coated with a flock coating which covers at least part of said applicator surface, said flock coating extending into said groove.

120. The device of claim 119, wherein said groove has a first portion and a second portion configured so that at least during a first filling operation, said first portion is filled with said product prior to said second portion being filled with said product.

121. The device of claim 119, wherein said reservoir has an annular skirt coupled to said applicator endpiece, said annular skirt contacting a surface of said applicator endpiece which is coated with said flock coating.

122. The device of claim 119, wherein said applicator endpiece is coupled to said reservoir body so as to define a gap between said applicator endpiece and an outer surface of said reservoir body, said gap being in communication with said orifice and with said groove.

123. The device of claim 122, wherein said flock coating extends into said gap.

124. The device of claim 123, wherein said flock coating covers all surfaces of said applicator endpiece.

125. A device for dispensing a product comprising:

a reservoir body containing said product, said reservoir body defining at least one orifice at an end of said reservoir body;

an applicator endpiece disposed at said end of said reservoir body so as to define a gap between said applicator endpiece and said reservoir body, said gap being in communication with said orifice and extending in a plane transverse to an axis of said orifice;

at least one groove extending through said applicator endpiece from said gap to an applicator surface disposed on an exterior of said device, said at least one groove having a first portion and a second portion, said first portion being disposed closer to said orifice than said second portion, said at least one groove extending from said gap to said applicator surface in a direction transverse to said plane.

126. The device of claim 125, wherein said orifice is offset from a center of said gap.

127. The device of claim 126, wherein said at least one groove is symmetrically positioned with respect to the center of said gap.

128. The device of claim 126, wherein a width of said at least one groove is larger than a spacing between said reservoir body and said endpiece corresponding to a width of said gap.

129. A device for dispensing a product, comprising:

reservoir body defining at least one orifice, and an applicator endpiece disposed on said reservoir body, wherein said applicator endpiece defines a groove in communication with said orifice, said applicator endpiece having an applicator surface, said applicator endpiece being coated with a flock coating which covers at least part of said applicator surface, said flock coating extending into said groove.

130. A device for dispensing a product, comprising:

a reservoir body defining at least one orifice, and and applicator endpiece disposed on said reservoir body, wherein said applicator endpiece defines a groove in communication with said orifice, said applicator endpiece having an applicator surface, said applicator endpiece being coated with a flock coating which coves at least part of said applicator surface, said applicator endpiece including a central region and a peripheral region forming said groove therebetween and being interconnected by a plurality of bridges.

131. A device according to claim 130, wherein said bridges are deprived of a flock coating.

132. A device for dispensing a product, comprising:

a reservoir body defining at least one orifice; and an applicator endpiece coupled to said reservoir body, wherein said applicator endpiece has an applicator surface being fed with product through at least one passage extending through said applicator endpiece, said passage opening out both on said applicator surface and on an interior surface facing the reservoir body by at least one oblong groove, and said device further comprising bridges across said groove.

* * * * *

UNITED STATES PATENT AND TRADEMARK OFFICE

CERTIFICATE OF CORRECTION

PATENT NO. : 6,688,317 B2
DATED : February 10, 2004
INVENTOR(S) : Jean-Louis Gueret It is certified that error appears in the above-identified patent and that said Letters Patent is hereby corrected as shown below:

Column 11,
Line 15, change “9” to -- 1 --.
Line 29, change “11” to -- 12 --.
Line 66, change “21” to -- 20 --.

Column 13,
Line 53, change “for said” to -- for pumping said --.

Column 21,
Line 2, change “coves” to -- covers --.

Signed and Sealed this

Seventeenth Day of August, 2004

JON W. DUDAS
*Acting Director of the United States Patent and Trademark Office*